US007185795B1

(12) United States Patent
Wallick

(10) Patent No.: US 7,185,795 B1
(45) Date of Patent: Mar. 6, 2007

(54) COLLAPSIBLE HANGER FOR SUSPENDING CLOTHES AND OTHER ITEMS

(76) Inventor: James R. Wallick, 3216 S. 2750 East, Saint George, UT (US) 84790

( * ) Notice: Subject to any disclaimer, the term of this patent is extended or adjusted under 35 U.S.C. 154(b) by 0 days.

(21) Appl. No.: 11/258,572

(22) Filed: Oct. 25, 2005

(51) Int. Cl.
*A41D 27/22* (2006.01)

(52) U.S. Cl. ..... 223/89

(58) Field of Classification Search ..... 223/85–98
See application file for complete search history.

(56) References Cited

U.S. PATENT DOCUMENTS

| | | | | |
|---|---|---|---|---|
| 3,645,426 | A * | 2/1972 | Glascock et al. | 223/89 |
| 3,703,978 | A * | 11/1972 | Sammartino et al. | 223/89 |
| 4,793,399 | A * | 12/1988 | Pryor | 160/345 |
| 4,813,581 | A | 3/1989 | LaMont | |
| 5,007,562 | A | 4/1991 | Brink et al. | |
| 5,044,534 | A * | 9/1991 | Hwang | 223/94 |
| 5,590,823 | A | 1/1997 | Lunde | |
| 5,893,493 | A | 4/1999 | Nolray | |
| 6,328,187 | B2 * | 12/2001 | Sugita | 223/94 |
| 6,427,882 | B1 | 8/2002 | Harvey | |
| 6,722,538 | B1 * | 4/2004 | Autry et al. | 223/94 |
| 2006/0097017 | A1 * | 5/2006 | Hill et al. | 223/85 |

* cited by examiner

*Primary Examiner*—Shaun R. Hurley
(74) *Attorney, Agent, or Firm*—John D. Lister

(57) ABSTRACT

A collapsible hanger for suspending clothing and other items includes: a pin; a suspension member mounted on the pin; and first, second, and third hanger arms. The ends of the first hanger arm are pivotally joined to the pin and the second hanger arm. The ends of the second hanger arm are pivotally joined to the first and third hanger arms. The third hanger arm has one end pivotally joined to the second hanger arm and the other end detachably mounted on the pin to form the hanger arms into a triangular configuration or detached from the pin whereby the hanger arms can be suspended from the pin in a generally straight-line configuration. The second hanger arm is an articulated arm with segments pivotal between a first folded position when the hanger is collapsed into a compact configuration and a second unfolded position where the first and second sections are in releasably held in longitudinal alignment.

12 Claims, 3 Drawing Sheets

FIG. 2
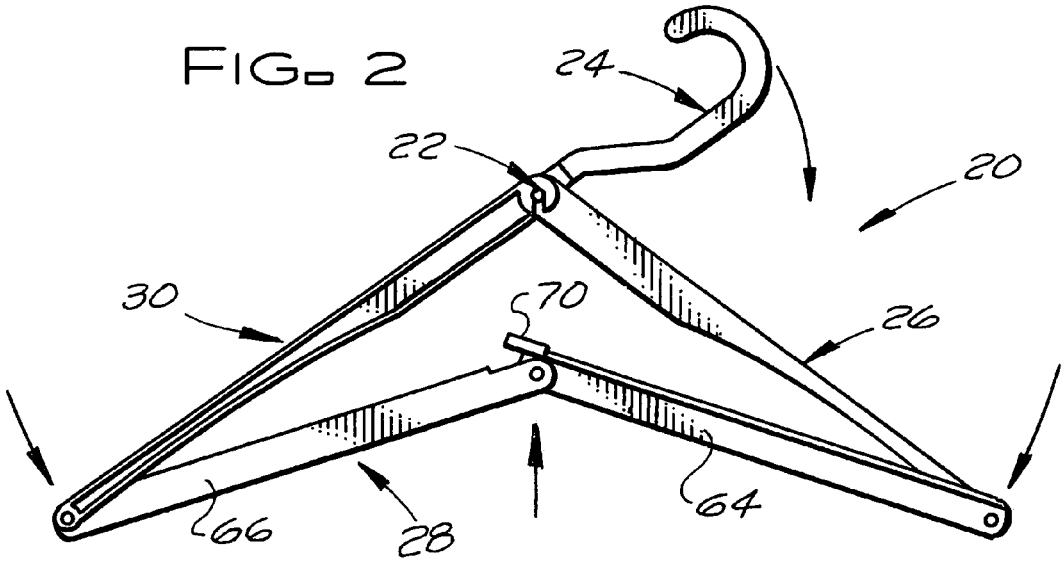
FIG. 3
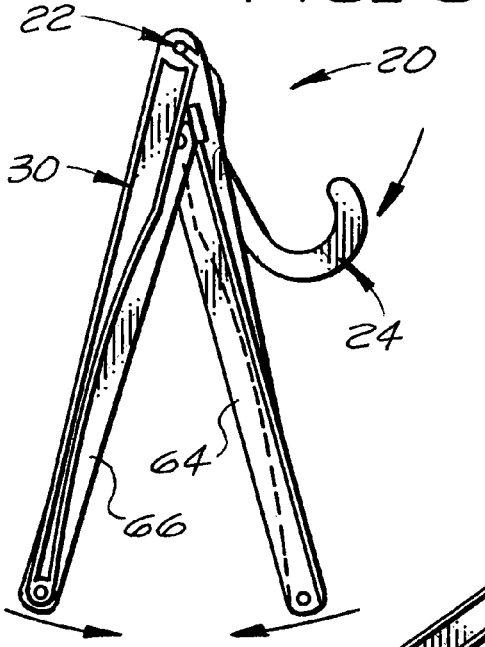
FIG. 4
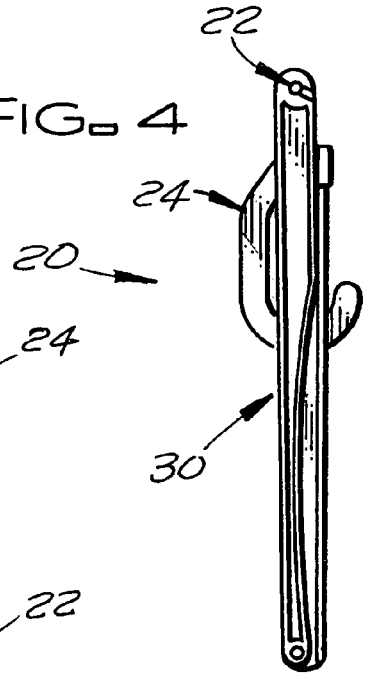
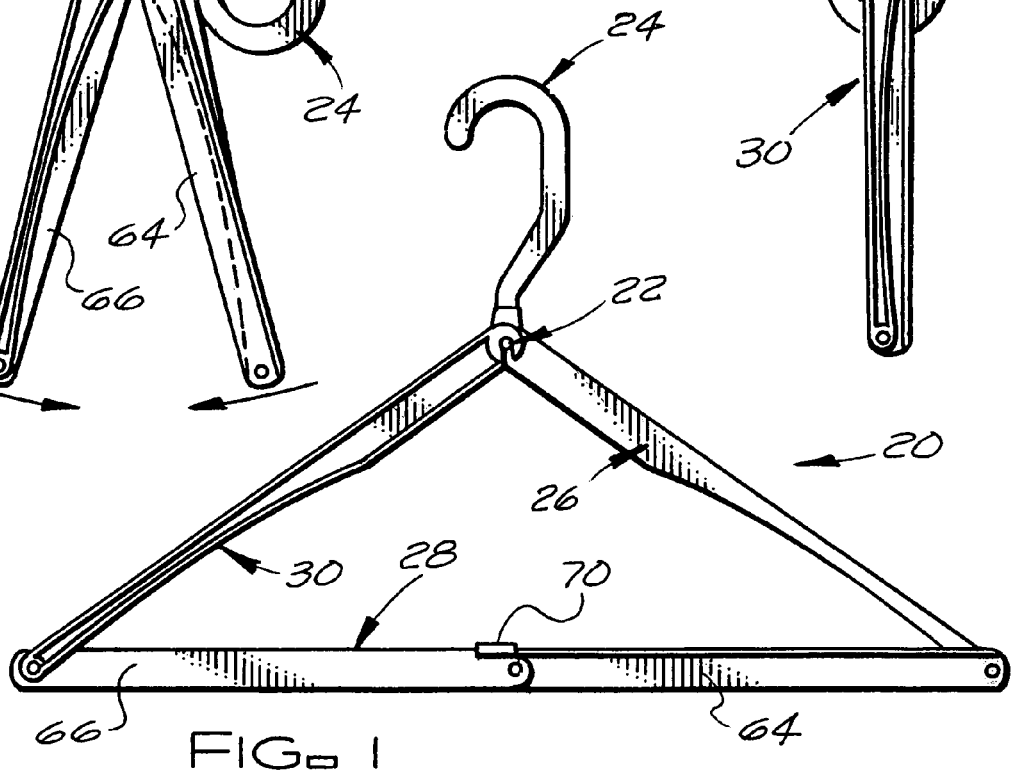
FIG. 1

24
44
46
26
30
22
20
52
48
78
74
72
54
28
66
70
76
60
68
64
56
58
62

FIG. 7
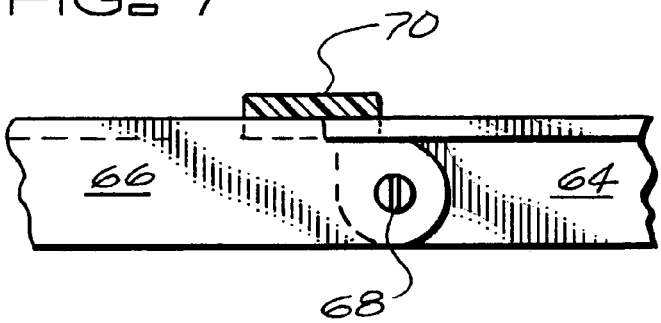
FIG. 8
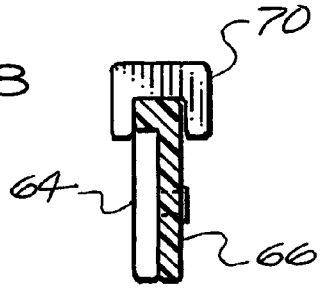
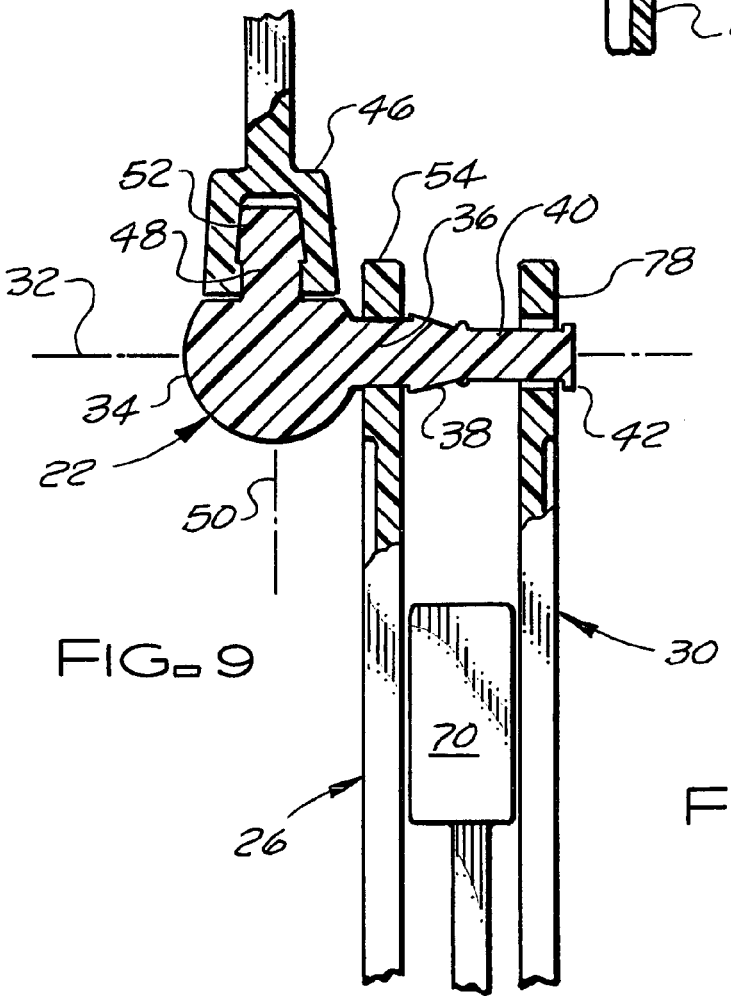
FIG. 9
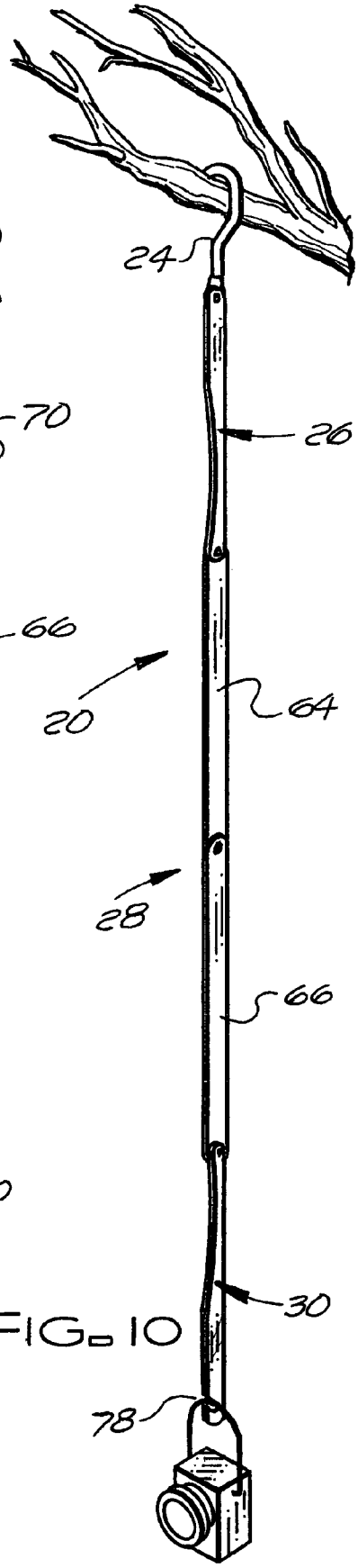
FIG. 10

COLLAPSIBLE HANGER FOR SUSPENDING CLOTHES AND OTHER ITEMS

BACKGROUND OF THE INVENTION

The subject invention relates to a collapsible hanger and in particular, to a collapsible hanger for suspending clothing and other items that can be quickly and easily unfolded from a very compact collapsed configuration into the generally triangular configuration of a clothes hanger or into a generally straight line configuration so that clothing and/or other items can be suspended from a free end of a hanger arm.

Persons frequently have a need for a clothes hanger or other hanger in a situation where none is readily available. When a person is traveling, hotels, motels, and the like frequently fail to provide a sufficient number of clothes hangers for their guests. In locations, such as airport restrooms, highway rest stops, fitness centers, and the like, where a person may want to change into a clean shirt or other garment from their luggage or otherwise make him/herself more presentable, he/she may want to temporarily hang a garment or other item from a support while changing or grooming him/herself. A clothes hanger or other hanger can also be needed when visiting friends or relatives. In addition, when camping in tents or in a recreation vehicle, a camper often needs a clothing hanger and/or a hanger for suspending a lantern or other item from the branch of a tree or some other suitable support.

Accordingly, it is an object of the subject invention to provide a low cost, durable, easy to use, lightweight collapsible hanger that can be used as a clothes hanger and/or as a hanger for other items.

It is another object of the subject invention to provide a collapsible hanger that can support relatively heavy garments without collapsing and that can support other relatively heavy items suspended from the collapsible hanger.

It is a further object of the subject invention to provide a collapsible hanger that can be used as a clothes hanger and/or a hanger for other items that collapses into a very compact configuration so that it can be easily carried in a travel bag, a piece of carry on luggage, a suitcase, a vanity case, gym bag, a purse, or the like.

SUMMARY OF THE INVENTION

The collapsible hanger of the subject invention for suspending clothing and other items from a suitable support fulfills all of the objectives set forth above in the background of the invention. The collapsible hanger of the subject invention includes: a pin member; a suspension member mounted on the pin member for engaging a support and suspending the collapsible hanger from the support; and first, second, and third hanger arms. In one preferred embodiment of the invention, the suspension member has an upper hook shaped portion that passes over and engages a support bar, closet rod, a projecting support edge, a tree limb, or other suitable support from which the collapsible hanger is suspended.

The end portions of the first hanger arm are pivotally joined to the pin member and the second hanger arm. The end portions of the second hanger arm are pivotally joined to the first and third hanger arms. The third hanger arm has one end portion pivotally joined to the second hanger arm. The other end portion of the third hanger arm is free and can be attached to the pin member to form the three hanger arms of the collapsible hanger into the triangular configuration of a clothes hanger or detached from the pin member whereby the three hanger arms are suspended from the pin member in a generally straight line configuration so that clothes or other items can be suspended from the free end portion of the third hanger arm.

The second hanger arm is an articulated arm with segments that are pivotal between a first folded position when the hanger is collapsed into a compact configuration for storage and a second unfolded position where the first and second sections of the second hanger arm are automatically but releasably held in longitudinal alignment with respect to each other simply by placing the segments in the unfolded position. Preferably, the suspension member is mounted on the pin member so that in use the suspension member can be pivoted relative to the pin member about vertical and/or horizontal axes.

With the pivotal mounting of the suspension member on the pin member, the articulated construction of the second hanger arm, the pivotal joining of the hanger arms to each other, and the pivotal joining of the first and third hanger arms to the pin member, the second hanger arm of the collapsible hanger can be folded in half and located between the first and third hanger arms of the collapsible hanger and the suspension member can be pivoted into a position along side the first hanger arm so that the collapsible hanger can be stored and carried in a very compact configuration. When fully collapsed, a typical collapsible hanger of the subject invention is about 10 inches in length, by about 2.25 inches at its greatest width, by about 1 inch at its greatest thickness so that the collapsible hanger can be easily carried in a travel bag, a piece of carry on luggage, a suitcase, a vanity case, gym bag, a purse, or the like.

BRIEF DESCRIPTION OF THE DRAWINGS

FIG. 1 is a side view of the collapsible hanger of the subject invention with the hanger arms in the triangular configuration of a clothes hanger.

FIGS. 2 to 4 successively show the collapsible hanger of FIG. 1 being collapsed from the triangular configuration of a clothes hanger to a fully collapsed configuration for storage and handling when the collapsible hanger is not in use.

FIG. 7 is a partial side view of the second hanger arm showing the automatic locking component for releasably locking the segments of the second hanger arm in place when the collapsible hanger is unfolded from its fully collapsed configuration.

FIG. 8 is a transverse cross section through one of the segments of the second hanger arm to further illustrate the automatic locking component for releasably locking the segments of the second hanger arm in place when the collapsible hanger is unfolded from its fully collapsed configuration.

FIG. 9 is a transverse view of an upper portion of the collapsible hanger of FIG. 1 with the pin member and a lower portion of the suspension member in cross section.

FIG. 10 is a perspective view showing the collapsible hanger of FIG. 1 unfolded into its generally straight-line configuration to support an item from the third hanger arm.

DESCRIPTION OF THE PREFERRED EMBODIMENTS

Figures 5, 6:
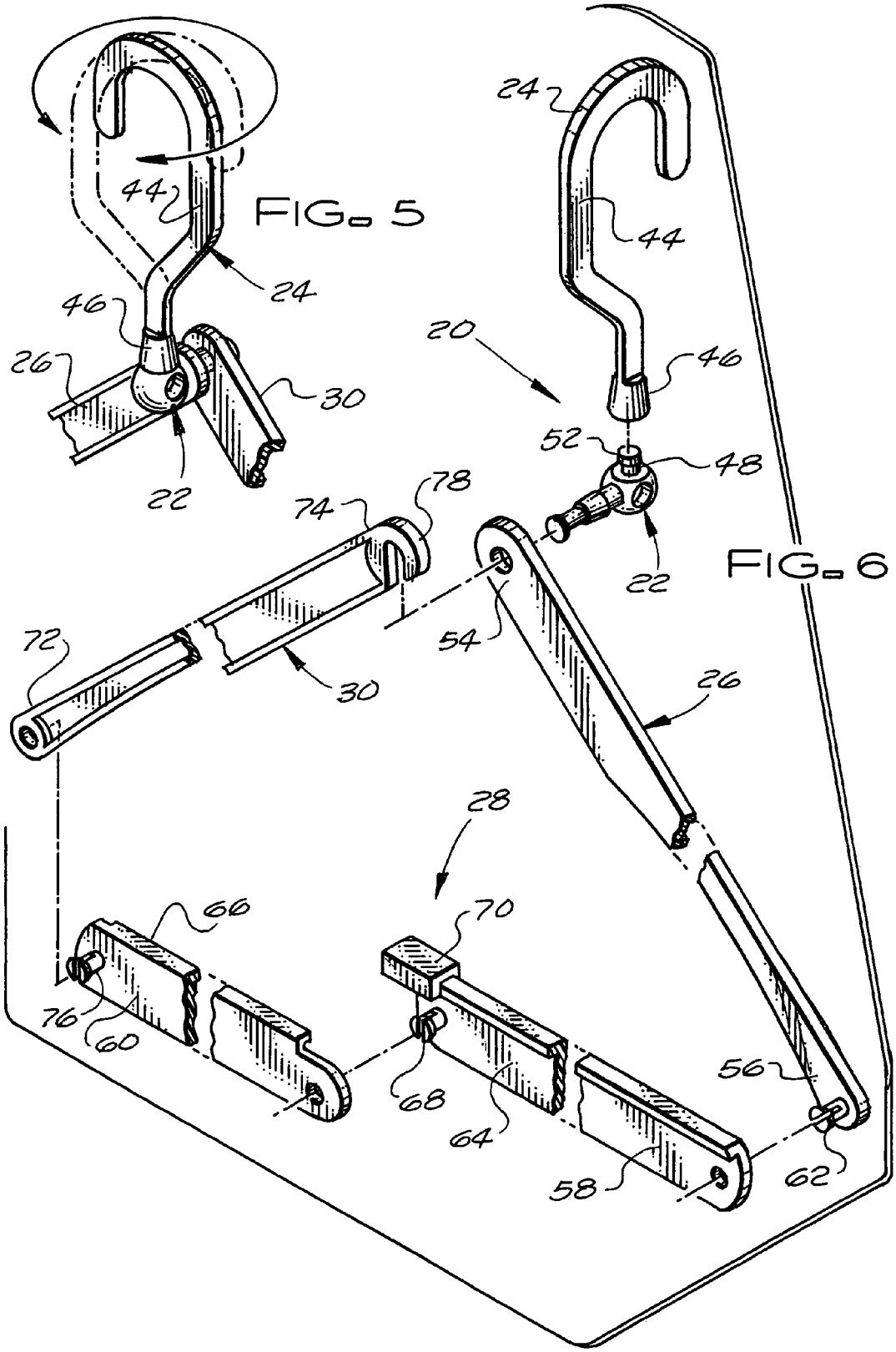
FIG. 5 is shows a preferred suspension member of the collapsible hanger of FIG. 1.
FIG. 6 is an exploded perspective view of the collapsible hanger of FIG. 1.

As shown in FIGS. 1 to 4, the collapsible hanger 20 of the subject invention for suspending clothing and other items from a support includes: a pin member 22, a suspension member 24, a first hanger arm 26, a second hanger arm 28, and a third hanger arm 30. Preferably, the collapsible hanger 20 is made of a conventional, commercially available thermoplastic polymer based material. However, it is also contemplated that the collapsible hanger 20 could be made of a metallic material such as but not limited to aluminum.

The pin member 22 has a longitudinal axis 32 and preferably is about 1.25 to 1.5 inches in length. The pin member 22 has: a first end portion 34 upon which the suspension member 24 is mounted, an adjacent portion 36 upon which a first end portion of the arm 26 is rotatably mounted, a frustoconical shaped spacer portion 38, a second end portion 40 upon which a second free end portion of the third arm 30 is normally rotatably and detachably mounted, and an annular flange 42 at the second end to prevent the second free end portion of the third arm 30 from sliding off of the second end portion 40 of the pin.

The suspension member 24 has an upper support-engaging portion 44 for engaging and suspending the collapsible hanger 20 from a support bar, closet rod, a projecting support edge, a tree limb, or other suitable support, and a base portion 46 that is rotatably mounted on the first end portion 34 of the pin member 22. Thus, when the suspension member 24 is suspended from a support, the suspension member 24 supports and suspends the pin member 22 and, through the pin member 22, the hanger arms 26, 28 and 30 of the collapsible hanger 20 in their folded, triangular, or generally straight line configuration from the support.

As best shown in FIG. 9, a pin 48 projects from the first end portion 34 of the pin member 22. The pin 48 has a longitudinal axis 50 that is perpendicular to the longitudinal axis 32 of the pin member 22. The pin 48 projects into a bore in the lower portion 46 of the suspension member 24 and is rotatably retained within the lower portion 46 of the suspension member 24 by an annular flange of the head 52 of the pin 48 that engages an annular flange of the bore to thereby rotatably secure the suspension member 24 to the pin member 22. With this structure, the suspension member 24 can be rotated with the pin member 22 about the longitudinal axis 32 of the pin member 22 and can also be rotated about the longitudinal axis 50 of the pin 48. Accordingly, the upper support-engaging portion 44 of the suspension member 24 can be rotated relative to the hanger arms 26, 28, and 30 of the collapsible hanger 20 (in their folded, triangular, or generally straight configuration) about two relatively perpendicular axes 32 and 50, e.g. a horizontal axis and a vertical axis, to engage a support for suspending the collapsible hanger 20. Thus, the collapsible hanger 20 and clothes or other items suspended from the hanger can be oriented relative to a support from which the collapsible hanger 20 is suspended for the convenience of a person using the hanger and/or to avoid obstructions below the support. Preferably, the suspension member 24 is about 4 to 6 inches in height and the upper support-engaging portion 44 of the suspension member 24 has a hook shaped section with an internal radius of about 0.75 inches to easily pass over and engage a support.

The first hanger arm 26 is an elongated member that is typically about 10 inches in length. The first hanger arm 26 has a first end portion 54 and a second end portion 56. As indicated above, the first end portion 54 of the first hanger arm 26 is rotatably mounted on portion 36 the pin member 22, between the bulbous first end portion 34 of the pin member 22 and a shoulder of the frustoconical spacer portion 38 of the pin member 22 so that the first arm 26 can be pivoted relative to the pin member 22 about the longitudinal axis 32 of the pin member.

The second hanger arm 28 is an elongated member that is typically about 16 inches in length. The second hanger arm 28 has a first end portion 58 and a second end portion 60. The first end portion 58 of the second hanger arm 28 is rotatably joined to the second end portion 56 of the first hanger arm 26 by a pin 62 for pivotal movement relative to the first hanger arm from a folded position when the collapsible hanger 20 is in its collapsed configuration to unfolded positions when the collapsible hanger is formed into its triangular or generally straight configurations. The second hanger arm 28 is an articulated arm that has a first segment 64 and a second segment 66 that about equal in length. The first segment 64 and the second segment 66 of the second hanger arm 28 are rotatably joined together by a pin 68, intermediate the first and second end portions of the second arm 28, for pivotal movement relative to each other between a folded position when the collapsible hanger 20 is in its collapsed configuration to unfolded positions when the collapsible hanger is formed into its triangular or generally straight configurations.

The second hanger arm 28 is provided with a locking component 70 for releasably holding the first and second segments 64 and 66 of the second hanger arm in longitudinal alignment when the collapsible hanger 20 is unfolded into its triangular or generally straight configurations. Preferably, the locking component 70 automatically locks the first and second segments of the second hanger arm 28 into longitudinal alignment when the first and second segments are pivoted into longitudinal alignment to form the collapsible hanger into its triangular or generally straight line configurations from its collapsed configuration. A preferred locking component 70 for automatically and releasably locking the first and second segments of the second hanger arm 28 in longitudinal alignment is an inverted, generally U-shaped, extension that extends from the top of side segment 64 or 66 (as shown from segment 64). When the segments 64 and 66 of the second hanger arm 28 have been pivoted in a first direction from their folded positions when the collapsible hanger 20 is in its collapsed configuration, into longitudinal alignment when the collapsible hanger 20 has been formed into its triangular or generally straight line configurations, the inverted, generally U-shaped, extension forming the locking component 70 automatically overlaps and engages the top side of the other segment (as shown segment 66) adjacent where the segments are rotatably joined by the pin 68 to prevent further pivotal movement of the segments relative to each other in that first direction and retain the segments in longitudinal alignment. However, while the extension forming the locking component 70 prevents further pivotal movement of the segments 64 and 66 of the hanger arm 28 relative to each other in the first direction, the extension forming the locking component 70 permits pivotal movement of the segments 64 and 66 relative to each other to fold the collapsible hanger 20 back into its collapsed configuration.

A sleeve that is slidably mounted on the second hanger arm 28 to be moved over the joint between the segments 64 and 66 of the second hanger arm 28 when the segments are in longitudinal alignment or some other locking component could be used to retain the segments 64 and 66 of the second hanger arm 28 in longitudinal alignment. However, it is preferred to have an automatic locking component 70, such as the locking component formed by the extension, that eliminates the need for additional manipulation of the hanger components when the hanger is being set up for use or folded for storage.

The third hanger arm 30 an elongated member that is typically about 10 inches in length. The third hanger arm 30 has a first end portion 72 and a second free end portion 74. The first end portion 72 of the third hanger arm 30 is rotatably joined to the second end portion 60 of the second hanger arm 28 by a pin 76 for pivotal movement relative to the second hanger arm from a folded position when the collapsible hanger 20 is in its collapsed configuration to unfolded positions when the collapsible hanger is formed into its triangular or generally straight configurations. The free end portion 74 of the third hanger arm 30 has an attachment component 78 that can be rotatably and detachably mounted on portion 40 of the pin member 22. With this structure the third hanger arm 30 can be pivoted relative to the pin member 22 about the longitudinal axis 32 of the pin member 22 from its folded position when the collapsible hanger 20 is in its collapsed configuration to an unfolded position when the collapsible hanger is formed into its triangular configuration or the third hanger arm 30 can be detached from the pin member 22 to extend the hanger arms 26, 28 and 30 into a generally straight line configuration. Preferably, the free end portion 74 of the third hanger arm 30 is hook shaped to form the attachment component 78. The hook shaped attachment component 78 passes over and engages the portion 40 of the pin member 22 and has an internal radius and resilience causes the hook shaped attachment component 78 to rotatably and detachably grip portion 40 of the pin member 22.

With the first and third hanger arms 26 and 30 aligned with each other and the third hanger arm 30 attached to the pin 22 (as shown in FIG. 4), the first and third hanger arms 26 and 30 (as shown in FIG. 9) are spaced from each other a distance sufficient to accommodate the first and second segments 64 and 66 of the second hanger arm 28. Thus, with the first and second segments 64 and 66 of the second hanger arm 28 in the folded position, the first and second segments 64 and 66 of the second hanger arm 28 can be pivoted relative to the first and second hanger arms 26 and 30 to bring the first and second segments of the second hanger arm 28 between and in longitudinal alignment with the first and second hanger arms 26 and 28. In addition, the suspension member 24 can be pivoted to a position along side the first hanger arm 26 whereby, for compact storage in a fully collapsed state, the collapsible hanger 20 has a length substantially equal that of the first hanger arm 26. In a fully collapsed configuration, the collapsible hanger 20 typically has a length between about 9 and 11 inches, a thickness between about 0.75 to about 1.5 inches, and a width, except for the suspension member 24, between about 0.75 and 1 inches.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A collapsible hanger for suspending clothing and other items, comprising:

a pin means; the pin means having a longitudinal axis;

a suspension member; the suspension member having a support-engaging means for engaging a support and suspending the collapsible hanger from the support; and the suspension member being secured to and supporting the pin means whereby the suspension member supports the pin means when the collapsible hanger is suspended from a support by the suspension member;

a first hanger arm; the first hanger arm having a first end portion and a second end portion; the first end portion of the first hanger arm being rotatably mounted on the pin means for pivotal movement about the longitudinal axis of the pin means;

a second hanger arm, the second hanger arm having a first end portion and a second end portion; the first end portion of the second hanger arm being rotatably joined to the second end portion of the first hanger arm for pivotal movement relative to the first hanger arm; the second hanger arm being an articulated hanger arm having a first segment and a second segment that are rotatably joined together intermediate the first and second end portions of the second hanger arm for pivotal movement relative to each other between a folded position and an unfolded position where the first and second segments are in releasably held in longitudinal alignment; and a third hanger arm, the third hanger arm having a first end portion and a second end portion; the first end portion of the third hanger arm being rotatably joined to the second end portion of the second hanger arm for pivotal movement relative to the second hanger arm; and the third hanger arm having a free end with attachment means that can be rotatably attached to the pin means to enable the first, second, and third hanger arms to be unfolded from a collapsed configuration into a generally triangular configuration and detached from the pin means wherein the first, second, and third hanger arms can be suspended in substantially a straight line configuration from the pin means by the first end portion of the first hanger arm and the free end of the third hanger arm can be used to suspend an item from the collapsible hanger.

2. The collapsible hanger according to claim 1, wherein:

the support-engaging means of the suspension means is hook shaped for engaging a support and suspending the collapsible hanger from the support.

3. The collapsible hanger according to claim 2, wherein:

the suspension means is mounted on the pin means for rotational movement with the pin means about the longitudinal axis of the pin means and the support-engaging means of the suspension means is rotatable about a second axis that extends perpendicular to the longitudinal axis of the pin means.

4. The collapsible hanger according to claim 3, wherein:

the first and second segments of the second hanger arm have integral locking means, automatically actuated by placing the first and second segments of the second hanger arm in the unfolded position, for releasably holding the first and second segments of the second hanger arm in longitudinal alignment in the unfolded position.

5. The collapsible hanger according to claim 4, wherein: the attachment means on the second free end of the third hanger arm is a hook means that partially encircles the pin means to releasably attach the second free end of the third hanger arm to the pin means to form the first, second, and third hanger arms into a generally triangular configuration and that can be used to suspend an item from the collapsible hanger when the second free end of the third hanger arm is not attached to the pin means.

6. The collapsible hanger according to claim 5, wherein: with the first and second segments of the second hanger arm in the folded position, the first and second segments of the second hanger arm can be pivoted relative to the first and third hanger arms to bring the first and second segments of the second hanger arm between and in longitudinal alignment with the first and third hanger arms and the suspension means can be pivoted to a position along side one of the hanger arms whereby, for compact storage in a fully collapsed state, the collapsible hanger has a length substantially equal that of the first hanger arm.

7. The collapsible hanger according to claim 1, wherein: the suspension means is mounted on the pin means for rotational movement with the pin means about the longitudinal axis of the pin means and the support-engaging means of the suspension means is rotatable about a second axis that extends perpendicular to the longitudinal axis of the pin means.

8. The collapsible hanger according to claim 1, wherein: the first and second segments of the second hanger arm have integral locking means, automatically actuated by placing the first and second segments of the second hanger arm in the unfolded position, for releasably holding the first and second segments of the second hanger arm in longitudinal alignment in the unfolded position.

9. The collapsible hanger according to claim 1, wherein: the attachment means on the second free end of the third hanger arm is a hook means that partially encircles the pin means to releasably attach the second free end of the third hanger arm to the pin means to form the first, second, and third hanger arms into a generally triangular configuration and that can be used to suspend an item from the collapsible hanger when the second free end of the third hanger arm is not attached to the pin means.

10. The collapsible hanger according to claim 1, wherein: with the first and second segments of the second hanger arm in the folded position, the first and second segments of the second hanger arm can be pivoted relative to the first and third hanger arms to bring the first and second segments of the second hanger arm between and in longitudinal alignment with the first and third hanger arms and the suspension means can be pivoted to a position along side one of the hanger arms whereby, for compact storage in a fully collapsed state, the collapsible hanger has a length substantially equal that of the first hanger arm.

11. The collapsible hanger according to claim 1, wherein: the first and third hanger arms are each about 10 inches long; the second hanger arm is about 16 inches long; and the support-engaging means of the suspension means is hook shaped portion having an internal radius of about 0.75 inches and the suspension means is about 4 to 6 inches in height.

12. The collapsible hanger according to claim 1, wherein: the collapsible hanger is made of a thermoplastic polymer based material or a metallic material.

* * * * *